US007214143B2

(12) United States Patent
Deshmukh

(10) Patent No.: US 7,214,143 B2
(45) Date of Patent: May 8, 2007

(54) GOLF CLUB HEAD WITH A FACE INSERT

(75) Inventor: Uday V. Deshmukh, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 182 days.

(21) Appl. No.: 10/907,066

(22) Filed: Mar. 18, 2005

(65) Prior Publication Data

US 2006/0211514 A1 Sep. 21, 2006

(51) Int. Cl.
*A63B 53/04* (2006.01)

(52) U.S. Cl. ..... 473/342; 473/345

(58) Field of Classification Search ..... 473/324–350
See application file for complete search history.

(56) References Cited

U.S. PATENT DOCUMENTS

| | | | | |
|---|---|---|---|---|
| 1,167,387 | A | | 1/1916 | Daniel |
| 1,638,916 | A | | 8/1927 | Butchart |
| 1,780,625 | A | | 11/1930 | Mattern |
| 2,750,194 | A | | 6/1956 | Clark |
| 3,692,306 | A | | 9/1972 | Glover |
| 3,897,066 | A | | 7/1975 | Belmont |
| 3,937,474 | A | | 2/1976 | Jepson et al. |
| 3,970,236 | A | | 7/1976 | Rogers |
| 3,975,023 | A | | 8/1976 | Inamori |
| 3,989,248 | A | | 11/1976 | Campau |
| 4,021,047 | A | | 5/1977 | Mader |
| 4,398,965 | A | | 8/1983 | Campau |
| 4,568,088 | A | | 2/1986 | Kurahashi |
| 4,872,685 | A | | 10/1989 | Sun |
| 4,877,249 | A | | 10/1989 | Thompson |
| 5,094,383 | A | | 3/1992 | Anderson |
| 5,106,094 | A | | 4/1992 | Desboilles et al. |
| 5,193,811 | A | | 3/1993 | Okumoto et al. |
| 5,255,918 | A | | 10/1993 | Anderson |
| 5,261,663 | A | | 11/1993 | Anderson |
| 5,261,664 | A | | 11/1993 | Anderson |
| 5,282,624 | A | | 2/1994 | Viste |
| 5,310,185 | A | | 5/1994 | Viollez et al. |
| 5,344,140 | A | | 9/1994 | Anderson et al. |
| 5,346,216 | A | | 9/1994 | Aizawa |
| 5,377,986 | A | | 1/1995 | Viollaz et al. |
| 5,398,935 | A | | 3/1995 | Katayama |
| 5,410,798 | A | | 5/1995 | Lo |
| 5,425,538 | A | | 6/1995 | Vincent et al. |
| 5,464,210 | A | | 11/1995 | Davis et al. |
| 5,467,983 | A | * | 11/1995 | Chen ..... 473/342 |
| 5,474,296 | A | | 12/1995 | Schmidt et al. |
| 5,499,814 | A | | 3/1996 | Lu |
| 5,516,107 | A | | 5/1996 | Okumoto et al. |
| 5,547,427 | A | | 8/1996 | Rigal et al. |

(Continued)

*Primary Examiner*—Eugene Kim
*Assistant Examiner*—Alvin A. Hunter, Jr.
(74) *Attorney, Agent, or Firm*—Michael A. Catania; Elaine H. Lo

(57) ABSTRACT

A golf club head (20) having a body (22) with a front wall (30) with an opening (32) and a striking plate insert (40) is disclosed herein. The striking plate insert (40) has a substrate base layer (40*a*) and a second layer (40*b*). The second layer (40*b*) is preferably composed of a nickel-iron alloy material. The golf club head (20) preferably has a volume between 200 cubic centimeters and 600 cubic centimeters. The golf club head (20) preferably has a mass between 140 grams and 215 grams.

20 Claims, 6 Drawing Sheets

U.S. PATENT DOCUMENTS 5,570,886 A 11/1996 Rigal et al.
5,624,331 A 4/1997 Lo et al.
5,743,813 A 4/1998 Chen et al.
5,776,011 A 7/1998 Su et al.
5,830,084 A 11/1998 Kosmatka
5,863,261 A 1/1999 Eggiman
5,888,148 A 3/1999 Allen
5,967,903 A * 10/1999 Cheng ..... 473/342
6,048,278 A 4/2000 Meyer et al.
6,146,571 A 11/2000 Vincent et al.
6,149,534 A 11/2000 Peters et al.
6,152,833 A 11/2000 Werner et al.
6,165,081 A 12/2000 Chou
6,354,962 B1 3/2002 Galloway et al.
6,428,427 B1 * 8/2002 Kosmatka ..... 473/349
6,440,011 B1 8/2002 Hocknell et al.
6,471,604 B2 10/2002 Hocknell et al.
6,491,592 B2 12/2002 Cackett et al.
2002/0187852 A1 * 12/2002 Kosmatka ..... 473/330
2004/0053704 A1 * 3/2004 Gilbert ..... 473/290
2005/0009630 A1 * 1/2005 Chao et al. ..... 473/342
2006/0079346 A1 * 4/2006 Hocknell et al. ..... 473/345

* cited by examiner

GOLF CLUB HEAD WITH A FACE INSERT

BACKGROUND OF THE INVENTION

1. Field of the Invention

The present invention relates to a golf club head. More specifically, the present invention relates to a golf club head with a face insert.

2. Description of the Related Art

High performance drivers employ relatively thin, high strength face materials. These faces are either formed into the curved face shape then welded into a driver body component around the face perimeter, or forged into a cup shape and connected to a body by either welding or adhesive bonding at a distance offset from the face of up to 0.75 inch. In a popular embodiment of the sheet-formed face insert driver, the weld between the formed face insert and the investment cast driver body is located on the striking face, a small distance from the face perimeter. It is common practice for the face insert to be of uniform thickness and to design the surrounding driver body component to be of equal thickness. In this way there is continuity of face thickness across the weld.

Most face inserts are composed of a titanium alloy material. Titanium alloys are generally classified into three types depending on the microstructure of the material developed after processing of the material. The three types are alpha alloys, alpha-beta alloys and metastable alloys, and these represent the phases present in the alloy at ambient temperatures. At ambient temperatures, the thermodynamic properties of titanium favors the alpha phase. However, alloying titanium with other elements allows for the high temperature beta phase to be present at ambient temperatures, which creates the alpha-beta and metastable beta microstructures. The metastable phase may be transformed into the alpha phase by heating the alloy to an intermediate elevated temperature, which results in a metastable titanium alloy with increased static strength.

Such high strength metastable titanium alloys have been used as face inserts for drivers with a high coefficient of restitution. However, the heat treatment process compromises the toughness of the material, where toughness is defined as the resistance of the material to fracture under loading. Thus, even heat treated, high strength, metastable titanium alloys have limited application as face inserts due to inferior fracture properties. Thus, there is a need for face inserts composed of titanium alloys with an appropriate microstructure for better fracture properties. This requires a proper balance between strength and toughness (resistance to fracture), without a substantial increae in the costs associated with manufacturing the face insert.

Several patents discloses face inserts. Anderson, U.S. Pat. Nos. 5,024,437, 5,094,383, 5,255,918, 5,261,663 and 5,261,664, disclose a golf club head having a full body composed of a cast metal material and a face insert composed of a hot forged metal material.

Viste, U.S. Pat. No. 5,282,624, discloses a golf club head with a cast metal body and a forged steel face insert with grooves on the exterior surface and the interior surface of the face insert and having a thickness of 3 mm.

Rogers, U.S. Pat. No. 3,970,236, discloses an iron club head with a formed metal face plate insert fusion bonded to a cast iron body.

Galloway, et al., U.S. Pat. No. 6,354,962, discloses a golf club head of a face cup design.

Some alloy materials that have desired inherent properties such as yield strength, tensile strength and hardness often have high densities, which limit the utilization of such materials in golf club heads. However, there is a need for a golf club head with a face insert that has the inherent properties of these materials while allowing for more discretionary mass than conventional face insert golf club heads.

BRIEF SUMMARY OF THE INVENTION

The present invention overcomes the problems of the prior art by providing a golf club head that has a body with a striking plate insert composed of a substrate material and a nickel-iron alloy layer. This allows the golf club head of the present invention to have better inherent properties such as yield strength, tensile strength and hardness while also having more discretionary mass than conventional face insert golf club heads.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

DETAILED DESCRIPTION OF THE INVENTION

Figure 1:
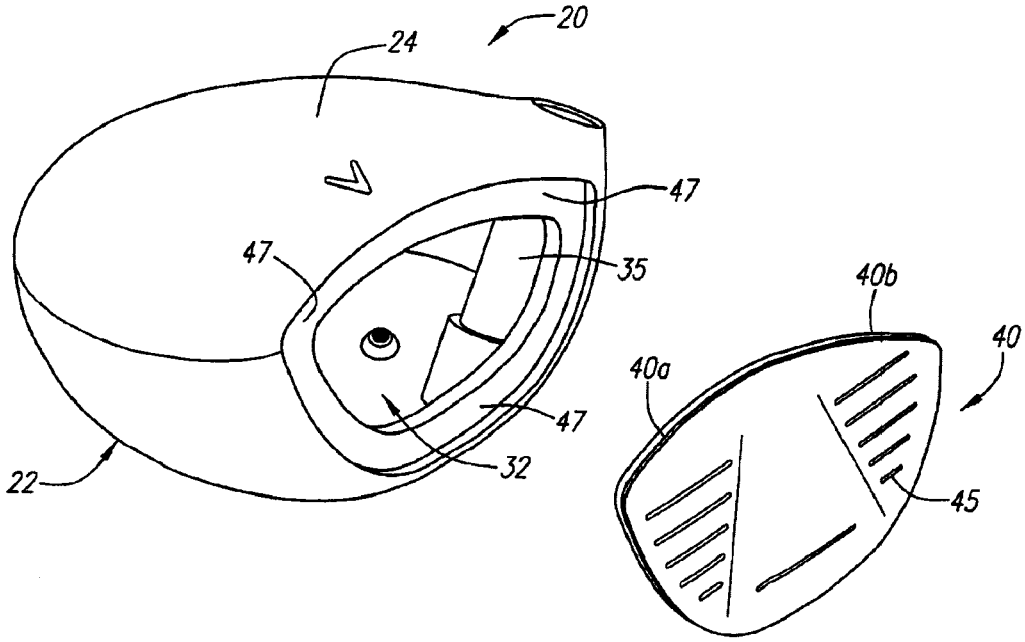
FIG. 1 is an exploded view of the components of a preferred embodiment of a golf club head.
Figure 2:
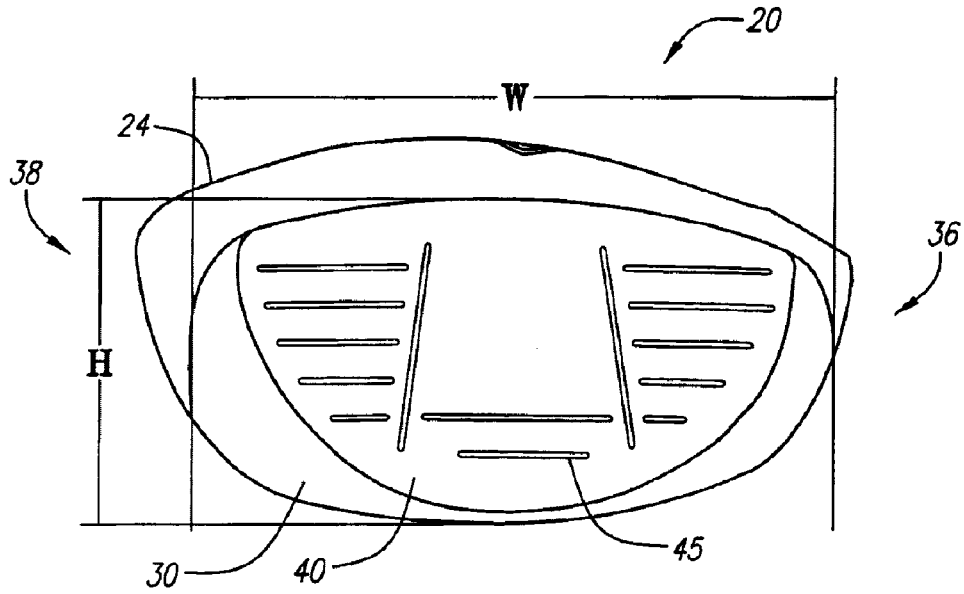
FIG. 2 is a front view of a golf club head.
Figure 3:
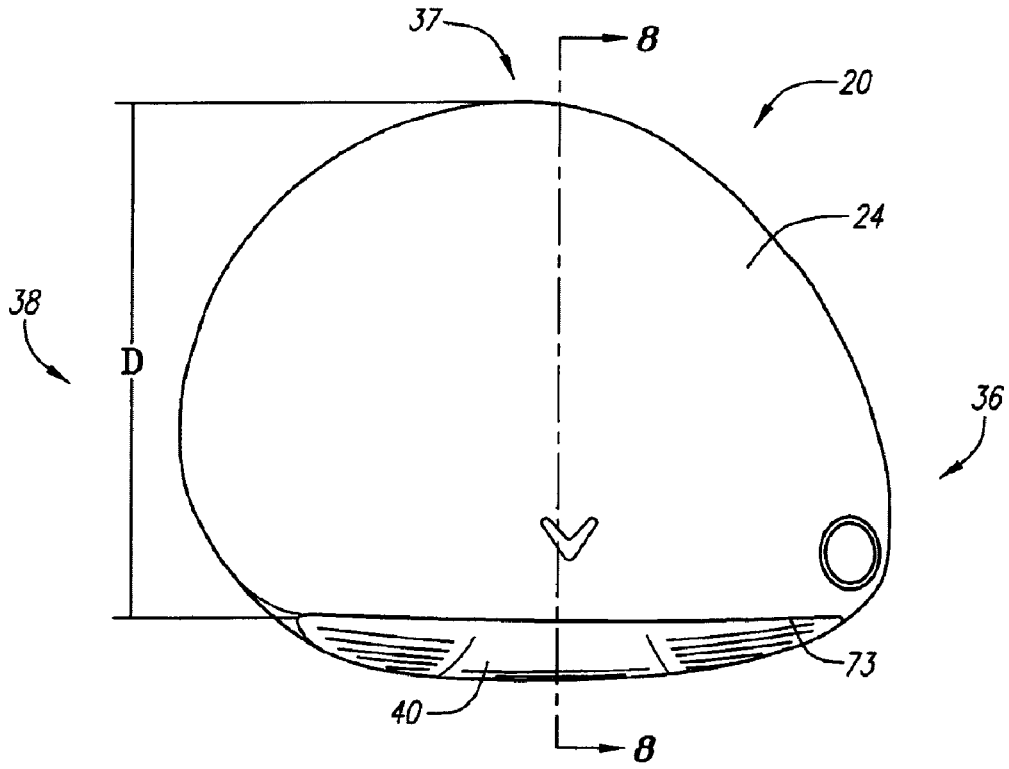
FIG. 3 is a top plan view of a golf club head.
Figure 4:
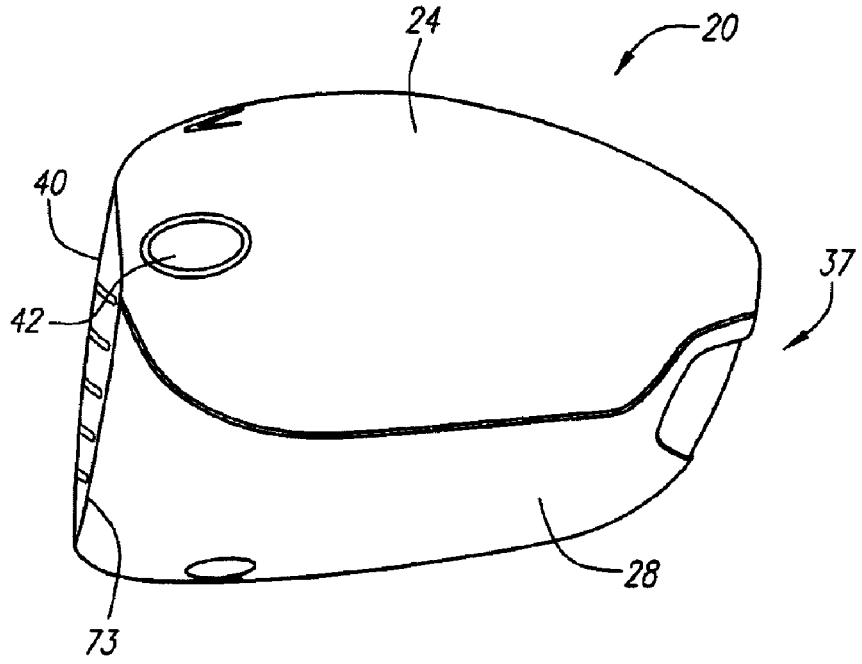
FIG. 4 is a side view of the heel end of a golf club head.
Figure 5:
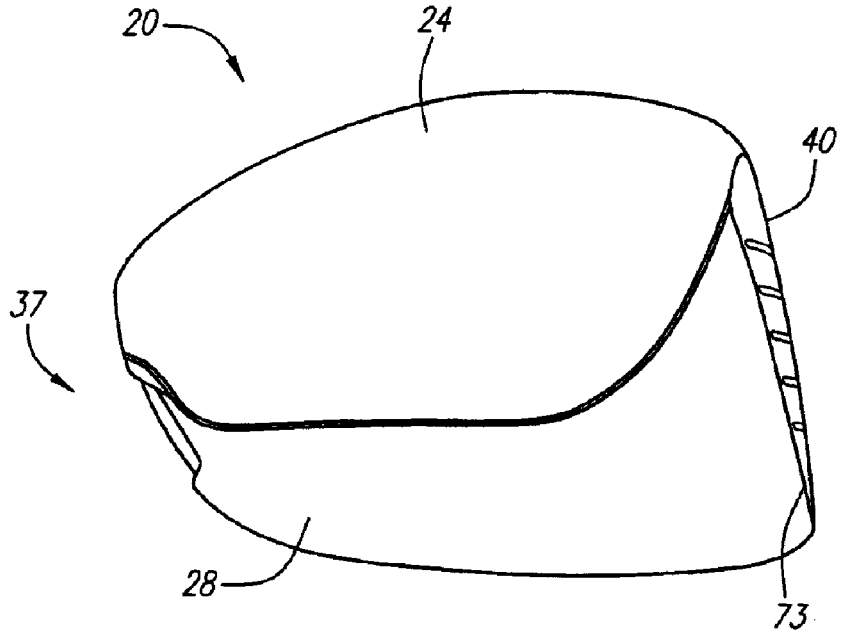
FIG. 5 is side view of the toe end of a golf club head.
Figure 6:
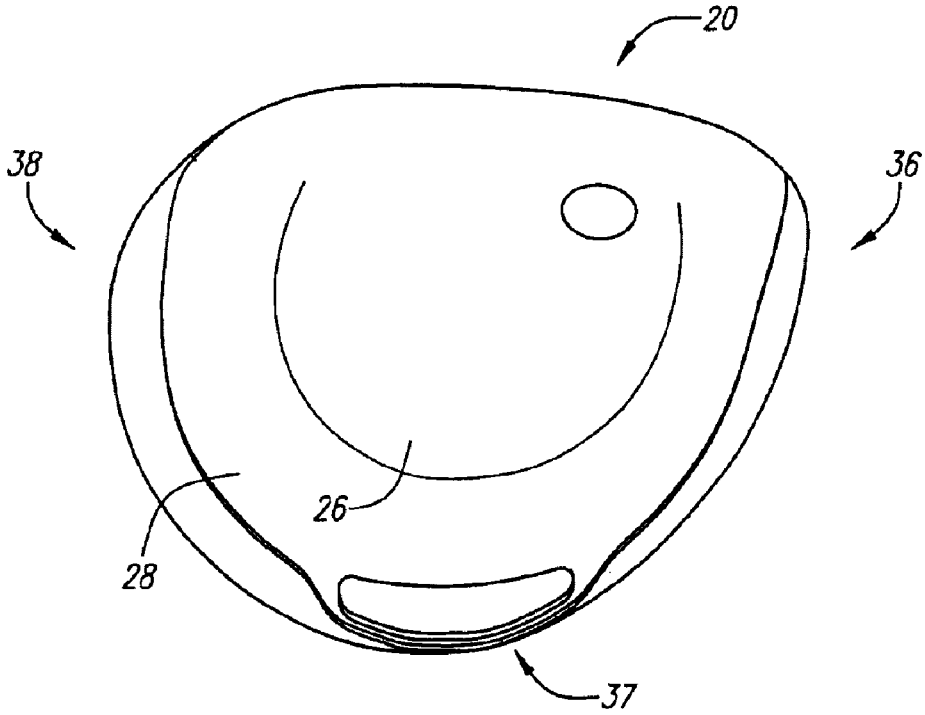
FIG. 6 is a bottom plan view of a golf club head.
Figure 7:
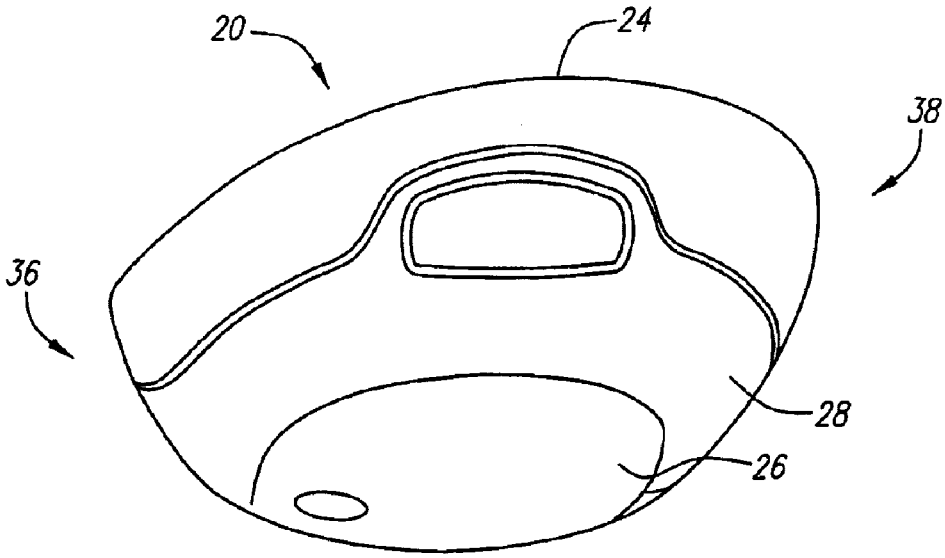
FIG. 7 is a rear view of a golf club head.
Figure 8:
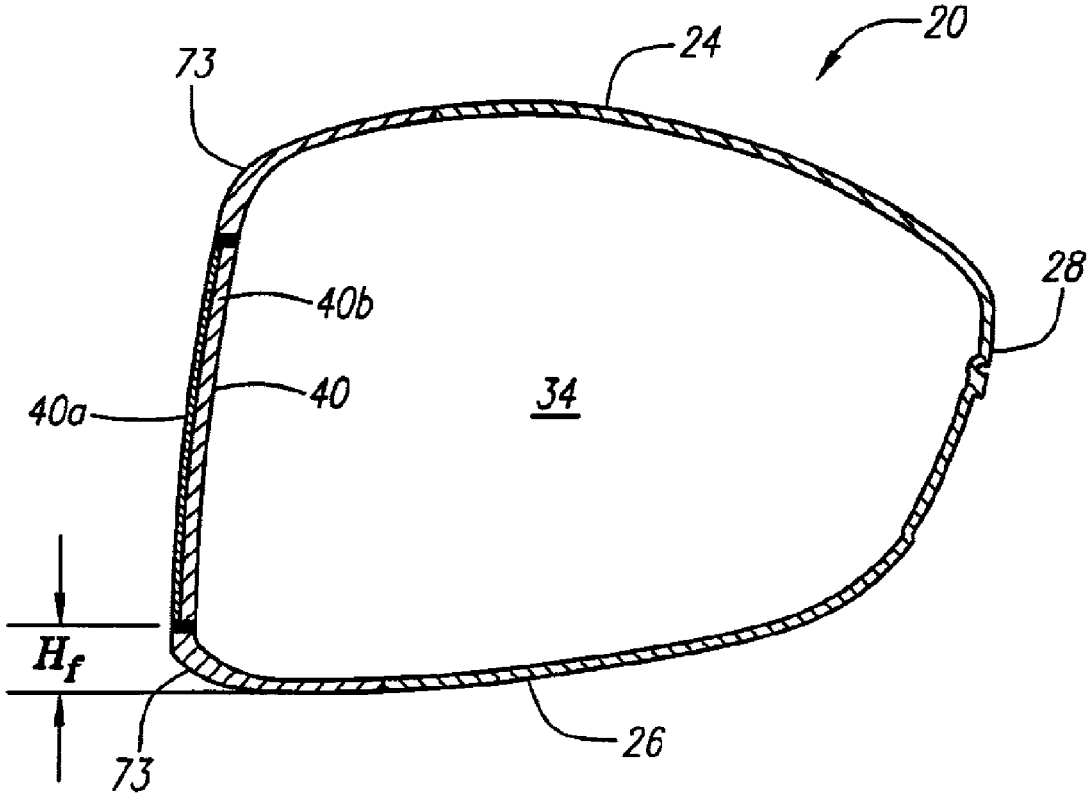
FIG. 8 is a cross-sectional view along line 8—8 of FIG. 3.
Figure 9:
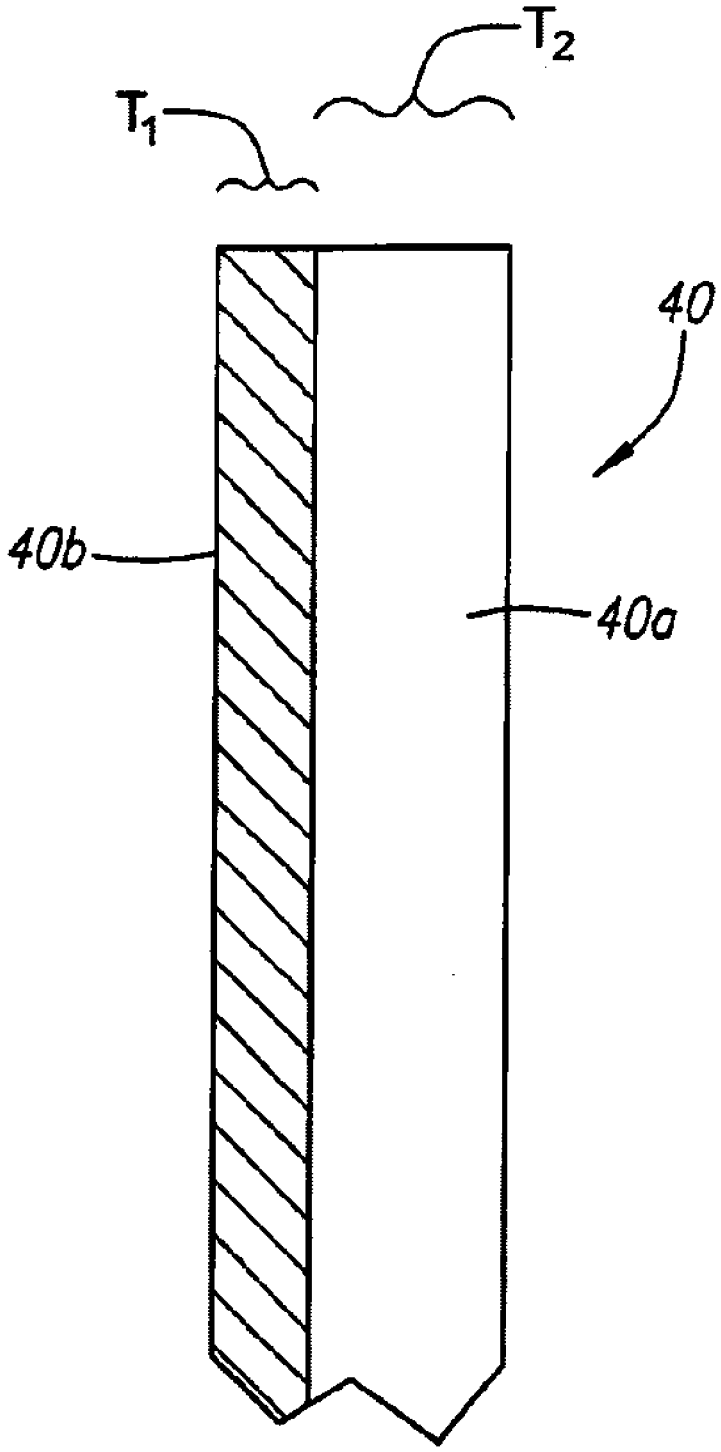
FIG. 9 is an enlarged isolated view of the striking plate insert.

As shown in FIGS. 1–8, the golf club head is generally designated 20. The golf club head 20 of FIGS. 1–8 is a driver, however, the golf club head may alternatively be a fairway wood. The golf club head 20 has a body 22 that is preferably composed of a metal material such as titanium, titanium alloy, steel alloys such as stainless steel, magnesium alloys, aluminum alloys, magnesium or aluminum material. A preferred metal material is composed of a cast titanium alloy material. The body 22 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 22 is composed of 17-4 steel alloy. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). Additional methods for manufacturing the body 22 include forming the body 22 from a flat sheet of metal, super-plastic forming the body 22 from a flat sheet of metal, machining the body 22 from a solid block of metal, electrochemical milling the body from a forged pre-form, casting the body using centrifugal casting, casting the body using levitation casting, metal injection molding (magnesium alloys) and like manufacturing methods.

Alternatively, the body is composed of a non-metal material. Such non-metal materials include plies of pre-preg material, thermoplastic materials, and other polymer materials. A preferred non-metal material is plies of pre-preg material such as disclosed in U.S. Pat. No. 6,648,773, which pertinent parts concerning a composite material body are hereby incorporated by reference.

The golf club head 20, when designed as a driver, preferably has a volume from 200 cubic centimeters to 600 cubic centimeters, more preferably from 300 cubic centimeters to 465 cubic centimeters, and most preferably from 350 cubic centimeters to 420 cubic centimeters. A golf club head 20 for a driver with a body 22 composed of a cast titanium alloy most preferably has a volume of 380 cubic centimeters. The volume of the golf club head 20 will also vary between fairway woods (preferably ranging from 3-woods to eleven woods) with smaller volumes than drivers.

The golf club head 20, when designed as a driver, preferably has a mass no more than 215 grams, and most preferably a mass of 180 to 215 grams. When the golf club head 20 is designed as a fairway wood, the golf club head preferably has a mass of 135 grams to 180 grams, and preferably from 140 grams to 165 grams.

The body 22 preferably has a crown 24, a sole 26, a ribbon 28, and a front wall 30 with an opening 32. The body 22 preferably has a hollow interior 34. The golf club head 20 has a heel end 36, a toe end 38, and an aft end 37. A shaft, not shown, is placed within a hosel, not shown, at the heel end 36. In a preferred embodiment, the hosel is internal to the body 22, and the shaft extends to the sole 30.

The golf club head 20 has striking plate insert 40 that is attached to the body 22 over the opening 32 of the front wall 30. The striking plate insert 40 comprises a substrate base layer 40*a* and a second layer 40*b*. The substrate base layer is preferably composed of a titanium material, a titanium alloy material, a steel alloy material such as stainless steel, a magnesium alloy material, a magnesium material, an aluminum alloy material, an aluminum material, and like metal materials. Preferred titanium alloys include 6-22-22 titanium alloy, Ti 10-2-3 alloy, and Beta-C titanium alloy, all available from RTI International Metals of Ohio, SP-700 titanium alloy (available from Nippon Steel of Tokyo, Japan), DAT 55G titanium alloy available from Diado Steel of Tokyo, Japan, and like materials. As shown in FIG. 1, the striking plate insert 40 typically has a plurality of scorelines 45 thereon.

The second layer 40*b* is preferably composed of a nickel-iron alloy material. One such nickel-iron alloy is nanocrystalline nickel, which is a nickel-iron alloy available from INTEGRAN company, which has a density of approximately 8.3 grams per cubic centimeter ("g/cm$^3$"). Nanocrystalline nickel has a yield strength ranging from 690 to over 900 MegaPascals ("MPa") depending on the crystal size, a tensile strength ranging from 1100 to 2000 MPa depending on crystal size, and a Vickers Hardness ranging from 300 to 650 Kilograms per millimeter ("Kg/mm$^2$") depending on crystal size.

In a preferred embodiment, the second layer is formed on the substrate base layer through a plating process. However, those skilled in the relevant art will recognize other methods for creating the striking plate insert 40 of the present invention.

In a preferred embodiment, the striking plate insert 40 has a thickness that ranges from 0.040 inch to 0.250 inch, more preferably a thickness of 0.060 inch to 0.120 inch, and is most preferably from 0.075 inch to 0.090 inch. The thickness of the striking plate insert 40 includes the thickness of both the substrate base layer 40*a* and the second layer 40*b*. In a preferred embodiment, the substrate base layer 40*a* is the exterior layer of the striking plate insert 40 and the second layer 40*b* is the interior layer of the striking plate insert 40. In an alternative embodiment, the substrate base layer 40*a* is the interior layer of the striking plate insert 40 and the second layer 40*b* is the exterior layer of the striking plate insert 40.

The thickness of the substrate base layer 40*a* preferably ranges from 0.035 inch to 0.070 inch, and more preferably from 0.040 inch to 0.065 inch. The thickness of the second layer 40*b* preferably ranges from 0.005 inch to 0.050 inch, and more preferably from 0.010 inch to 0.0035 inch. The second layer 40*b* is preferably 80% to 10% of the thickness of the substrate base layer 40*a*, more preferably 50% to 10% of the thickness of the substrate base layer 40*a*, and even more preferably 25% to 10% of the thickness of the substrate base layer 40*a*.

The striking plate insert 40 optimizes inherent properties while minimizing mass. The mass of the striking plate insert preferably ranges from 20 grams to 47 grams, and more preferably from 25 grams to 39 grams. The mass of the substrate base layer 40*a* preferably ranges from 25 grams to 35 grams. The mass of the second layer (40*b*) preferably ranges from 3 grams to 13 grams.

The second layer 40*b* preferably increases the durability of the striking plate insert 40. Alternatively, the second layer 40*b* allows for the same durability as a striking plate insert composed of a single material, while reducing the mass of the striking plate insert 40 as compared to a striking plate insert composed of a single material. The reduction in mass of the striking plate insert 40 allows for more mass to be placed throughout the body 22 in order to increase the mass properties of the golf club head 20, such as the moments of inertia, products of inertia and location of the center of gravity.

For example, a striking plate insert having an area of five square inches (32.26 square centimeters), a thickness of 0.108 inch (0.274 cm) and composed of the titanium alloy Ti-6-4 (specific gravity 4.43 grams per cubic centimeter) has a mass of approximately 39.20 grams. The mass of this comparative striking plate insert was compared striking plate inserts 40 of the present invention that have the same or greater durability as the comparative striking plate insert. As shown in Table One, the striking plate insert 40 of the present invention has a reduced mass with equal or greater durability to the comparative insert composed of only titanium alloy Ti-6-4. The substrate layer 40*a* of the examples of Table One were composed of the titanium alloy Ti-6-4 and the second layer 40*b* of the examples of Table One were composed of the nanocrystalline nickel available from INTEGRAN company.

TABLE ONE

| Insert Thickness (inch) | Substrate Thickness (inch) | Second Layer Thickness (inch) | Insert Mass (grams) | Difference from Comparative insert (mass) |
|---|---|---|---|---|
| 0.085 | 0.06 | 0.025 | 38.82 | 0.38 |
| 0.085 | 0.065 | 0.020 | 37.23 | 1.97 |
| 0.08 | 0.050 | 0.030 | 38.60 | 0.60 |

TABLE ONE-continued

| Insert Thickness (inch) | Substrate Thickness (inch) | Second Layer Thickness (inch) | Insert Mass (grams) | Difference from Comparative insert (mass) |
|---|---|---|---|---|
| 0.08 | 0.055 | 0.025 | 37.01 | 2.20 |
| 0.08 | 0.060 | 0.020 | 35.41 | 3.79 |
| 0.08 | 0.065 | 0.015 | 33.82 | 5.38 |
| 0.075 | 0.040 | 0.035 | 38.38 | 0.82 |
| 0.075 | 0.045 | 0.030 | 36.79 | 2.42 |
| 0.075 | 0.050 | 0.025 | 35.19 | 4.01 |
| 0.075 | 0.055 | 0.020 | 33.60 | 5.60 |
| 0.075 | 0.060 | 0.015 | 32.01 | 7.20 |
| 0.075 | 0.065 | 0.010 | 30.41 | 8.79 |

As shown in FIG. 1, the striking plate insert 40 is preferably welded to the front wall 30 of the body 22, thereby covering the opening 32. A plurality of tabs 47, preferably three, align the striking plate insert 40 for the welding process. Alternatively, the striking plate insert 40 is press-fitted into the opening 32. If the body 22 is composed of a non-metal material or even a non-compatible metal material, then the striking plate insert 40 is preferably adhered to the body 22 using an adhesive.

The golf club head 20 preferably has a high coefficient of restitution thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The club head 20 preferably has a coefficient of restitution preferably ranging from 0.80 to 0.87, and more preferably from 0.82 to 0.86, as measured under standard USGA test conditions.

The depth of the club head 20 from the striking plate insert 40 to the aft-end 37 preferably ranges from 3.0 inches to 4.5 inches, and is most preferably 3.75 inches. The height, "H", of the club head 20, as measured while in address position, preferably ranges from 2.0 inches to 3.5 inches, and is most preferably 2.50 inches or 2.9 inches. The width, "W", of the club head 20 from the toe end 38 to the heel end 36 preferably ranges from 4.0 inches to 5.0 inches, and more preferably 4.7 inches.

The center of gravity and the moments of inertia of the golf club head 20 may be calculated as disclosed in U.S. Pat. No. 6,607,452, entitled High Moment Of Inertia Composite Golf Club, and hereby incorporated by reference in its entirety. In general, the moment of inertia, lzz, about the Z-axis for the golf club head 20 will preferably range from 2700 g-cm$^2$ to 4000 g-cm$^2$, more preferably from 3000 g-cm$^2$ to 3800 g-cm$^2$. The moment of inertia, lyy, about the Y-axis for the golf club head 20 will preferably range from 1500 g-cm$^2$ to 3500 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf club head comprising:

a body comprising a crown, a sole, and a front wall with an opening; and a striking plate insert positioned within the opening and attached to the body, the striking plate insert having a thickness in the range of 0.075 inch to 0.090 inch, the striking plate insert comprising a substrate base layer and a second layer, the substrate base layer composed of a material selected from the group consisting of titanium, titanium alloy, steel alloy, magnesium, magnesium alloy, aluminum and aluminum alloy, the substrate base layer having a thickness ranging from 0.035 inch to 0.060 inch, the second layer composed of a nickel-iron alloy material, the second layer having a thickness ranging from 0.005 inch to 0.050 inch, wherein the golf club head has a volume ranging from 250 cubic centimeters to 460 cubic centimeters and a mass ranging from 185 grams to 215 grams, and the golf club head has a coefficient of restitution ranging from 0.80 to 0.85.

2. The golf club head according to claim 1 wherein the second layer of the striking plate insert is the interior layer and the substrate base layer is the exterior layer.

3. The golf club head according to claim 1 wherein the second layer of the striking plate insert is the exterior layer and the substrate base layer is the interior layer.

4. The golf club head according to claim 1 wherein striking plate insert has a mass ranging from 25.0 grams to 39.0 grams.

5. The golf club head according to claim 1 wherein the body is composed of a cast metal material.

6. The golf club head according to claim 1 wherein the body is composed of a cast titanium alloy material.

7. The golf club head according to claim 1 wherein the body is composed of a magnesium alloy material.

8. The golf club head according to claim 1 wherein the body is composed of plies of pre-preg material.

9. The golf club head according to claim 1 wherein the substrate base layer has a thickness of 0.065 inch and the second layer has a thickness of 0.010 inch.

10. A golf club head comprising:

a body having a crown, a sole, a ribbon, and a front wall with an opening, the body composed of a cast titanium alloy material; and a striking plate insert positioned within the opening, the striking plate insert having a thickness in the range of 0.075 inch to 0.090 inch and a mass ranging from 25.0 grams to 39.0 grams, the striking plate insert composed of a substrate base layer and a second layer, the substrate base layer composed of a titanium alloy material and having a thickness ranging from 0.035 inch to 0.070 inch, the second layer composed of a nickel-iron alloy material, the second layer having a thickness ranging from 0.005 inch to 0.050 inch, wherein the golf club head has a volume ranging from 300 cubic centimeters to 465 cubic centimeters, and the golf club head has a coefficient of restitution ranging from 0.80 to 0.85.

11. The golf club head according to claim 10 wherein the second layer of the striking plate insert is the interior layer and the substrate base layer is the exterior layer.

12. The golf club head according to claim 10 wherein the second layer of the striking plate insert is the exterior layer and the substrate base layer is the interior layer.

13. A golf club head comprising:

a body comprising a crown, a sole, and a front wall with an opening; and a striking plate insert positioned within the opening and attached to the body, the striking plate insert comprising a substrate base layer and a second layer, the substrate base layer composed of a material selected from the group consisting of titanium, titanium alloy, steel alloy, magnesium, magnesium alloy, aluminum and aluminum alloy, the second layer composed of a nickel-iron alloy material, the second layer having a thickness less than the thickness of the substrate base layer, wherein the golf club head has a volume ranging from 250 cubic centimeters to 460 cubic centimeters.

14. The golf club head according to claim 13 wherein the second layer has a thickness that is less than eighty percent of the thickness of the substrate base layer.

15. The golf club head according to claim 13 wherein the second layer has a thickness that is less than fifty percent of the thickness of the substrate base layer.

16. The golf club head according to claim 13 wherein the second layer has a thickness that is less than twenty-five percent of the thickness of the substrate base layer.

17. The golf club head according to claim 13 wherein the second layer has a thickness that is less than fifty percent of the thickness of the substrate base layer and more than ten percent of the thickness of the substrate base layer.

18. The golf club head according to claim 13 wherein the second layer has a mass that is greater than the mass of the substrate base layer.

19. The golf club head according to claim 13 wherein the second layer has a mass ranging from 3 grams to 13 grams.

20. The golf club head according to claim 13 wherein the substrate base layer has a mass ranging from 25 grams to 35 grams.

* * * * *